United States Patent [19]

Heffernan et al.

[11] 4,193,109

[45] Mar. 11, 1980

[54] PERSONNEL MARKER DEVICE

[75] Inventors: William R. Heffernan, Westfield; Mary-Louise Vega, Califon, both of N.J.; Edward T. Rockwell, Sr., Leominster, Mass.

[73] Assignee: American Cyanamid Company, Stamford, Conn.

[21] Appl. No.: 926,989

[22] Filed: Sep. 22, 1978

[51] Int. Cl.[2] ..... F21K 2/00

[52] U.S. Cl. ..... 362/34; 362/84; 362/109

[58] Field of Search ..... 362/34, 84, 109

[56] References Cited

U.S. PATENT DOCUMENTS

| | | | |
|---|---|---|---|
| 3,829,678 | 8/1974 | Holcombe | 362/34 |
| 3,900,728 | 8/1975 | Holcombe | 362/34 |

*Primary Examiner*—Stephen J. Lechert, Jr.

*Attorney, Agent, or Firm*—Gordon L. Hart

[57] ABSTRACT

A one-piece chemiluminescent lightstick tube with attached actuating device is protected in storage by an opaque sleeve slipped over the outside of the tube. The sleeve is cut away to pass the attachment and may be fitted with a fastening device such as a clip or pin.

3 Claims, 4 Drawing Figures

PERSONNEL MARKER DEVICE

The invention relates to improvements in chemiluminescent lightsticks.

In the copending U.S. patent application titled "Personnel Marker" and filed of even date herewith by M. L. Vega and E. T. Rockwell, Sr. who are coinventors herein, a chemiluminescent lightstick was described having a tubular flexible outer tube as a part of a single molded unit further comprising a lever and fulcram attached at one end of the lever to the wall of the tube near one of the tube ends. In a preferred embodiment of that invention, separate components for making a chemiluminescent mixture were contained inside the outer tube with each component contained in a separate closed glass vial. On flexing the outer tube by means of the lever and fulcram, the glass vials would be broken causing the components to mix and thereby produce chemical light.

The embodiment having the reactive components all in glass vials has the advantage that the lightstick can be stored without need for a hermetically sealed wrapper of metal-foil or other air-tight material to protect the components from exposure to air. The glass vials containing each component provide adequate protection from air, but do not protect from exposure to sunlight which causes some loss of activity of the components.

According to the present invention, there is provided a tubular sleeve of inside diameter to make the sleeve fit snugly around the outer cylindrical walls of the flexible tube member of a lightstick of the kind described in the aforesaid copending application. The opaque sleeve is of about the same length as the outer tube of the lightstick and one end of the sleeve is open for insertion of the free-end of the flexible tube into the sleeve.

Figure 1:
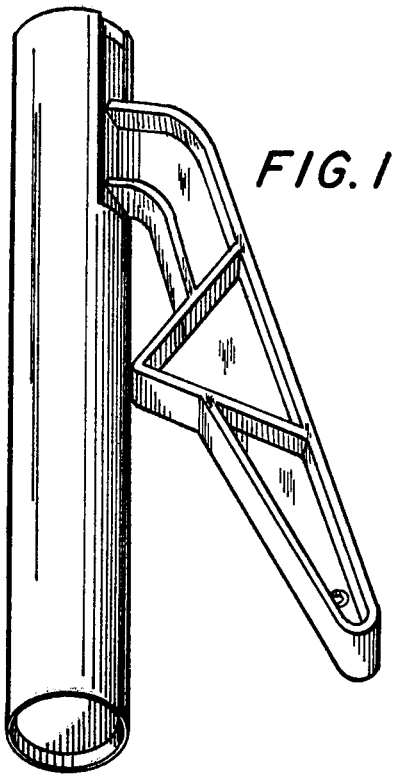
FIG. 1 shows a chemiluminescent lightstick with attached lever and fulcram, encased in a sleeve in accordance with the invention.
Figure 2:
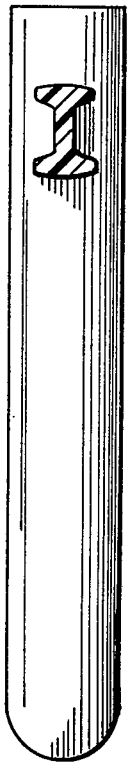
FIG. 2 is a view of the outer tube with the lever and fulcram cutaway at the joint.
Figure 3:
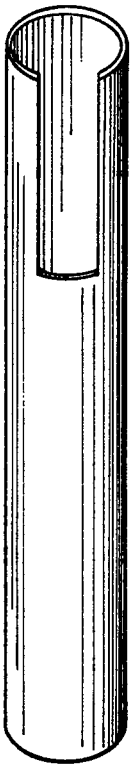
FIG. 3 is a view of the sleeve showing the cutaway portion as described.
Figure 4:
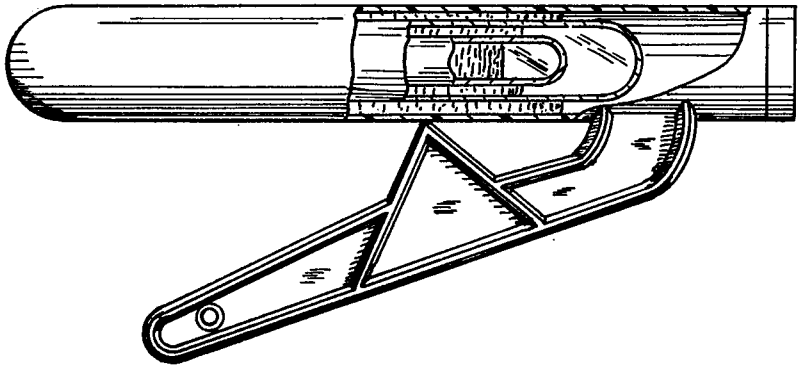
FIG. 4 is a view of the chemiluminescent lightstick with portions of the tubes cutaway to show the inner structure.

A portion of the sleeve wall is cut away from the open end so that the open end of the sleeve can be slipped past the joint of the lever to the tube wall by sliding the lever into the opening that has been cut away from the sleeve wall. This cut away opening is only wide enough and extends along the length of the tube wall only for a distance from the open end of the sleeve for a distance sufficient for one end of the sleeve to slide past the lever to the end of the tube. The opaque sleeve is preferably made from plastic film, a few mils thick e.g. from about two to about 10 mils thick. It may also be a sleeve made from metal foil or opaque paper or paper board or the like. The end of the opaque sleeve opposite the aforesaid open end is preferably closed, but it is not necessary. It is not the purpose of the sleeve to provide a hermetic envelope but rather to reduce the passage of light into the tube. The outer wall of the opaque sleeve may be used to bear printed matter such as trademarks, instructions, or the like.

The sleeve may be adapted with fastening means such as a clip, pin or the like attached to the sleeve, for convenience in fastening the package to a life vest or the like, ready for use in an emergency.

We claim:

1. A chemiluminescent lightstick and container therefor, comprising a unitary molded outer flexible translucent tube with attached lever and fulcram, the lever of which is joined by one of its ends to the outer wall of said tube at a joint near one end of said tube and, sealed inside said outer tubes, several components of a chemiluminescent mixture with separate components of said mixture sealed inside separate glass vials within said outer tube, an outer cylindrical sleeve open at one end and fitted snugly over the length of the outer wall of said tube by insertion of the free end of said tube through an open end of said sleeve, with a portion cut away from the wall of said sleeve at said open end, said cut away portion being of width only sufficient for said sleeve to pass said lever at said joint and of length only sufficient for said sleeve to slide past said joint to cover the full length of said tube except at said cut away portion.

2. A lightstick and container defined by claim 1 wherein the defined sleeve is opaque.

3. A lightstick defined in claim 1 wherein said sleeve is fitted with means for fastening the sleeve and said lightstick contained thereto to an article of clothing.

* * * * *